United States Patent [19]

Jensen, deceased et al.

[11] 4,333,188

[45] Jun. 8, 1982

[54] CONVERTIBLE SINK

[75] Inventors: Harald W. Jensen, deceased, late of Oak Brook, Ill., by Alice Jensen, executor; Christen V. Jensen, Itasca, Ill.

[73] Assignee: Stainless Steel Sinks, Inc., Addison, Ill.

[21] Appl. No.: 186,471

[22] Filed: Sep. 22, 1980

Related U.S. Application Data

[63] Continuation-in-part of Ser. No. 80,261, Oct. 1, 1979, abandoned.

[51] Int. Cl.[3] ..... A47K 3/14; E03C 1/186

[52] U.S. Cl. ..... 4/514; 4/505; 4/539

[58] Field of Search ..... 4/505, 514, 539, 553, 4/555, 557, 579, 638–640, 642, 654

[56] References Cited

U.S. PATENT DOCUMENTS

| | | | |
|---|---|---|---|
| 612,823 | 10/1898 | Conway | 4/514 |
| 615,499 | 12/1898 | Schmid | 4/514 |
| 836,628 | 11/1906 | Broeck | 4/514 |
| 990,371 | 4/1911 | Minns | 4/514 |
| 1,364,785 | 1/1921 | Muskin et al. | 4/554 |
| 1,817,330 | 8/1931 | Wilson | 4/514 |
| 2,109,989 | 2/1938 | Moyes | 4/514 |
| 2,203,052 | 6/1940 | Hanson | 4/514 |
| 2,580,638 | 1/1952 | Archie, Jr. | 4/514 |
| 2,651,784 | 9/1953 | Johnson et al. | 4/514 |
| 3,427,664 | 2/1969 | Mustee | 4/640 |

*Primary Examiner*—Henry K. Artis

*Attorney, Agent, or Firm*—Laff, Whitesel, Conte & Saret

[57] ABSTRACT

A sink is designed which can be converted into one, two or more separate basins. The sink has at least one rib protruding up along its inner surface. A removable dividing wall is provided with a plate portion and an elastic flange extending around the bottom and sides of the plate. Two detents extend from opposite sides of the sink at the ends of the rib. The detents engage the flange and deform it against the rib tightly enough to create a waterproof seal and separate basins. Drains are provided on either side of the dividing wall.

8 Claims, 10 Drawing Figures

CONVERTIBLE SINK

BACKGROUND OF THE INVENTION

This is a continuation-in-part of U.S. application Ser. No. 80,261, filed on Oct. 1, 1979 and now abandoned.

This invention relates to lavatories, sinks and the like, and more particularly, to a lavatory which can be divided into two or more separate lavatories by a partition or dividing wall.

Most lavatories or sinks sold today contain either one or two basins. The single basin lavatory usually includes a single drain and is generally satisfactory for accomplishing one task at a time, such as washing one's hands or soaking cooking utensils or pots.

The double basin lavatory is preferred when two different tasks are to be accomplished simultaneously, such as in the kitchen where one basin is filled with soapy water to wash dishes and the other basin is used to rinse the dishes and perhaps dispose of food waste. Usually, however, each of the basins in a double basin lavatory or sink are smaller than a single basin lavatory. Thus, when the intended use of the lavatory requires a large amount of space, e.g., when a large pot is to be washed and/or soaked, the double basin lavatory is often unsatisfactory.

Partitions have previously been used in sinks, tubs, or the like. In some cases, as in U.S. Pat. No. 3,427,664, the partitions were permanent structures integrally formed with the tub. In other instances, the partitions were supported in place with: groove and gasket constructions (U.S. Pat. Nos. 2,109,089 and 990,371); suction or vacuum cups, sometimes in combination with clamps or brackets (U.S. Pat. Nos. 1,817,330 and 2,203,052 and 2,651,784); or with locking rods in combination with interlocking, dovetail joints between the partition and the wall of the sink (U.S. Pat. No. 612,823). These types of partition supports have been found to be too costly to make or too unreliable in supporting the partition in a desired position and insuring a waterproof seal at the juncture of the partition with the sink or tub. Also, the elaborate means used to support these partitions often meant that it was difficult or time-consuming to remove the partition if desired.

Accordingly, there is a need for and it is an object of this invention to provide a lavatory which can be easily converted from a single basin to a double basin lavatory and conversely. Also, it is an object of this invention to provide a lavatory with a removable dividing wall which creates two separate and watertight compartments on either side of the dividing wall.

SUMMARY OF THE INVENTION

In keeping with one aspect of this invention, a convertible lavatory is constructed with a basin divided by a protruding rib extending along the inner surface of the basin. At the ends of the rib on opposite walls of the basin are two detents integrally formed with the basin.

A removable wall extends vertically from the floor of the lavatory along the rib to provide separate compartments within the basin. An elastic flange formed by insert molding is secured to the periphery of the wall with a heat sensitive adhesive. The bottom of the detents engage the flange and urge the flange and wall down against the rib of the basin to produce a waterproof seal.

The above mentioned and other features of this invention and the manner of obtaining them will become more apparent, and the invention itself will be best understood by reference to the following description of an embodiment of the invention taken in conjunction with the accompanying drawings.

DETAILED DESCRIPTION OF THE INVENTION

Figure 1:
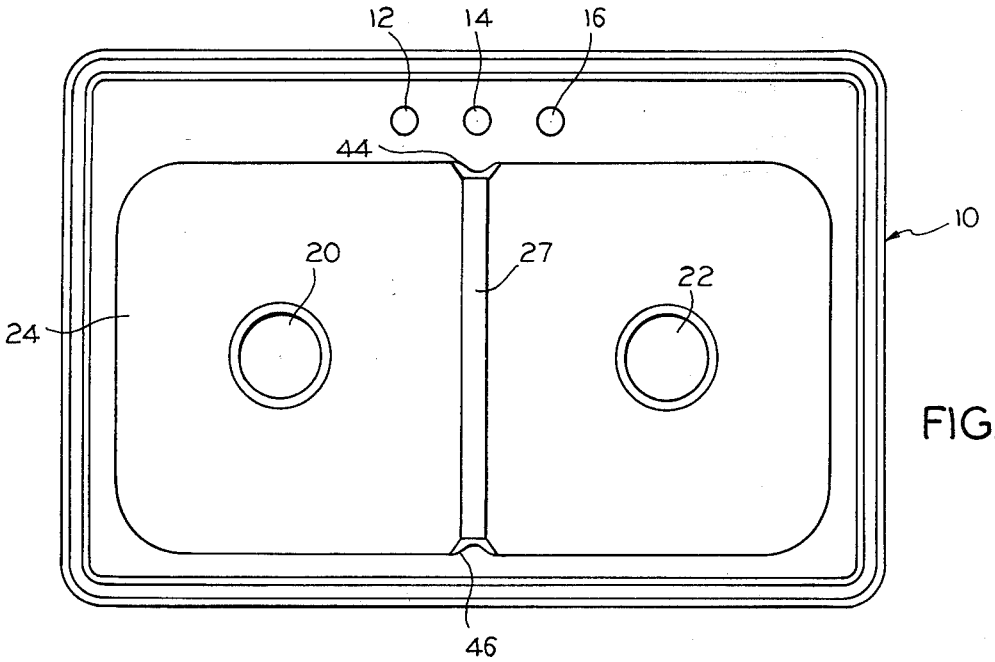
FIG. 1 is a top plan view of the invention.

As shown in FIG. 1, a convertible lavatory constructed in accordance with the teachings of this invention comprises a receptacle or basin 10 capable of holding a liquid. The basin may be metal, porcelain, plastic or a similar suitable material. The basin includes apertures 12, 14, and 16 for plumbing, but these apertures are not essential to the invention. Preferably, the basin also includes at least two drains 20 and 22 in the floor 24 of the basin for removing the liquid from the basin.

Figure 5:
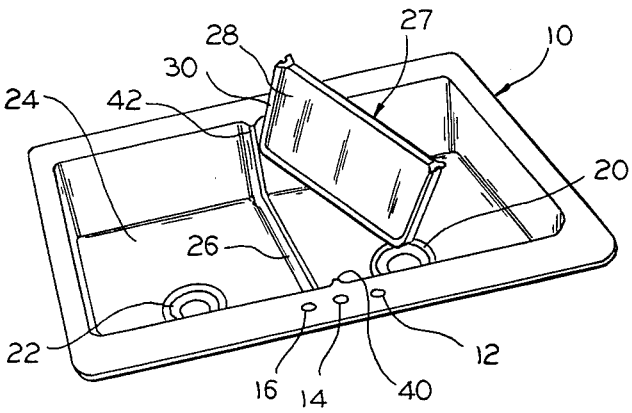
FIG. 5 is a perspective view of the invention.

The floor 24 of the basin 10 also includes a rib 26, best shown in FIG. 5, which extends along and protrudes up from the inner surface of the basin along the sides and bottom. The rib is preferably nearly an inverted U-shape. This rib 26 may bisect the basin or may be positioned anywhere within the basin so as to divide the basin into two portions, each of which is suitable for the intended use. For example, if the user wishes to attach a food disposal unit beneath one of the drains and use the remainder of the basin for washing dishes, the rib should be off-center within the basin so as to provide a relatively large area for washing dishes and a relatively small area for food disposal. It is desirable that the rib be molded into, or formed as an integral part of, the floor of the basin rather than be attached to the floor, but not an integral part thereof. In this way leakage problems can be avoided.

Figure 4:
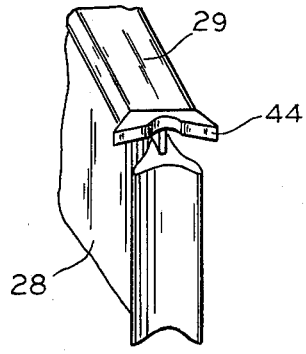
FIG. 4 is a perspective view of a portion of the dividing wall.
Figure 3:
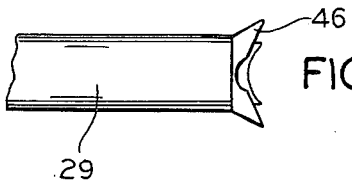
FIG. 3 is a top view of a portion of the dividing wall.
Figure 7:
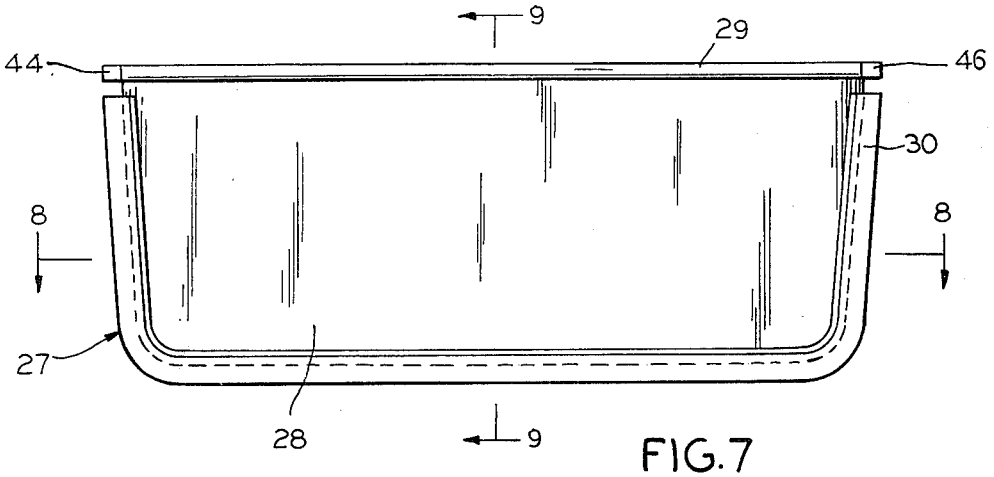
FIG. 7 is a side elevation view of the dividing wall.

The invention also includes a dividing wall 27, best shown in FIG. 7. This wall includes a plate portion 28 and a flange 30. The plate 28 defines a vertical cross section of the basin 10 and spans the distance between opposite sides of the basin. For example, if the basin is generally quadrangular, the plate will be rectangular and be of substantially the same length as the distance between opposite sides of the basin. The plate preferably corresponds in width to the height of the basin and may be constructed of any suitably rigid, waterproof material. One material which has been found suitable is stainless steel, which will correspond in appearance to a stainless steel basin. For esthetic purposes, the plate 28 may have a top portion 29, best shown in FIGS. 4 and 9, integrally formed with the vertical portion of the plate, but oriented horizontally thereto and approximately level with the top of basin 10. As shown in FIGS. 3 and 4, two generally V-shaped flanges 44 and 46 bridge the short gaps between the ends of top portion 29 and basin 10 and provide a smooth and finished appearance to the dividing wall 27.

Figure 6:
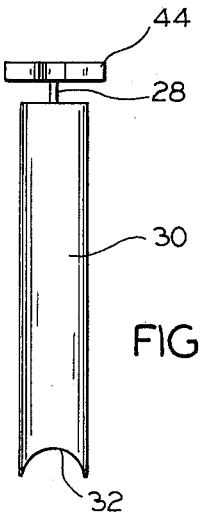
FIG. 6 is an end view of the dividing wall.
Figure 9:
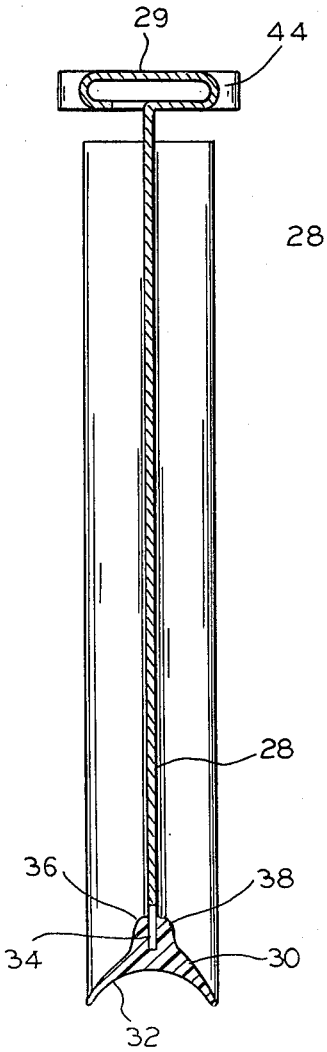
FIG. 9 is a cross sectional view of the dividing wall taken along line 9—9 in FIG. 7.

Flange 30 is an elastic strip, preferably a plastic such as polyvinyl chloride, which can easily be formed by molding. As shown in FIGS. 6 and 9, the bottom surface 32 of flange 30 should be shaped to mate with and engage rib 26.

Figure 8:
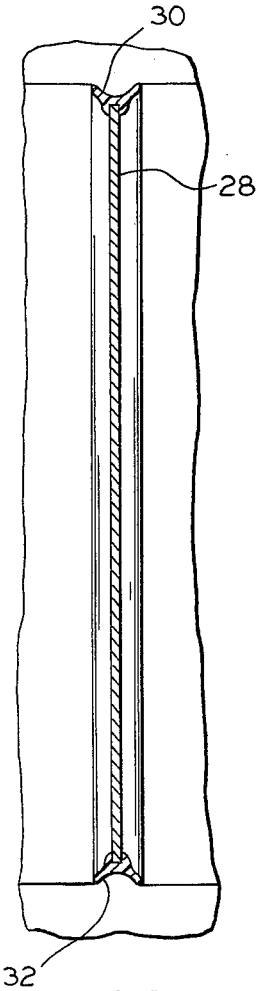
FIG. 8 is a cross sectional view of the dividing wall taken along line 8—8 in FIG. 7.

As best shown in FIGS. 8 and 9, the plate 28 engages flange 30 within a slot 34 extending the length of flange 30. Slot 34 is slightly smaller in width than the thickness of plate 28, and the slot should preferably be about one-quarter inch deep so as to firmly grip the plate along its periphery. The plate 28 can be held in the slot 34 merely by frictional engagement or, most desirably, by using a waterproof adhesive activated by the heat involved in molding the flange 30. With this latter method, the edge of the plate 28 upon which the flange 30 is to be applied is coated with the heat activated adhesive. When the plate 30 is inserted into the mold (not shown), the adhesive is activated and the molded flange 30 is thereby secured to the plate 28. The vinyl seal is preferably glossy and silver-colored to resist stains and blend with a stainless steel basin. The retaining walls 36 and 38 along slot 34 are bevelled at the top to further insure a tight, waterproof fit.

Figure 2:
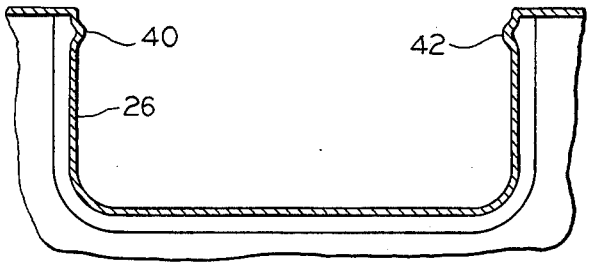
FIG. 2 is a cross sectional view of the basin.
Figure 10:
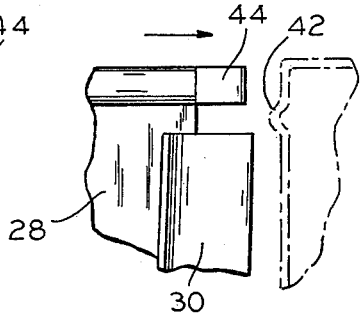
FIG. 10 is a side view of a portion of the dividing wall and a portion of the basin showing the manner of engagement of a detent and the flange.

As shown in FIG. 2, the invention includes a pair of detents or knobs 40 and 42 located at the ends of the rib near the top of opposite walls of basin 10. Like the rib 26, detents 40 and 42 are preferably integral parts of the basin. When the dividing wall 27 is properly installed, the bottom of the detents engage the top of flange 30, as shown in FIG. 10, and force it downwardly against rib 26 and basin 10. The deflection of the elastic flange against rib 26 and the consequent deformation of the flange produces a tight and waterproof seal.

The invention is easy to use. If a double basin lavatory or sink is desired, the dividing wall is positioned over the rib in the basin, and two separate compartments or sub-sinks on either side of the dividing wall are formed. If a single basin lavatory or sink is preferred, the dividing wall is merely removed and the double basin is converted into a single basin.

The many advantages of the invention are apparent. The lavatory can be constructed to fit within the existing space for ordinary lavatories and accommodate existing plumbing. Also, the lavatory can quickly and easily be converted from a single to a double basin or conversely. Of course, there are still other advantages which will be apparent to those skilled in the art.

While the principles of the invention have been described above in connection with specific apparatus and applications, it is to be understood that this description is made only by way of example and not as a limitation on the scope of the invention.

We claim:

1. A sink which can be divided into two or more watertight compartments, comprising: a liquid receptacle; at least one rib integrally formed within said receptacle extending along its internal surface; at least one plate spanning the distance between opposite sides of said receptacle; an elastic flange secured to the periphery of said plate along its edge; and a pair of detents located on opposite sides of said receptacle near the top of said rib to engage said flange and retain said flange against said rib, thereby causing a deformation of said flange and a mating of the flange and rib, which secures said plate within the receptacle.

2. A sink according to claim 1 wherein said flange is secured to said plate with a heat activated adhesive.

3. A sink according to claim 1 wherein said flange includes a slot for receiving and frictionally engaging said plate along its periphery.

4. A sink according to claim 1 wherein said rib is generally semi-circular in cross section and wherein said flange is correspondingly shaped but smaller in diameter to mate with said rib when the flange is deformed.

5. A sink according to claim 1 wherein said plate is stainless steel.

6. A sink according to claim 1 including at least one drain in said receptacle on either side of said rib.

7. A convertible lavatory comprising: a basin; a rib extending along the inside surface of said basin bisecting said basin; a pair of knobs located near the ends of said rib; a plate extending across said basin over said rib to produce two separate compartments in the basin; an elastic flange secured to and extending around the bottom and sides of said plate, said flange being adapted to mate with said rib; and means for urging said flange and said plate downwardly against said rib to deform said flange about said rib and produce a waterproof seal, whereby said knobs engage said flange on the sides of said plate and retain the plate in position across said basin.

8. In combination with a sink having sides, a floor, at least one drain on its floor, a plate spanning the distance between opposite sides of said sink to divide the sink in two sections, and an elastic flange secured to the sides and bottom of said plate, the improvement comprising a semi-circular rib integrally formed with and extending along opposite sides and the floor of said sink, said rib having a larger diameter than said flange, and a pair of detents integrally formed with and located on opposite sides of said sink near the top of said rib, whereby said flange is deformed when it is urged against said rib to produce a waterproof seal, and said plate is retained in position by the engagement of said flange with said detents.

* * * * *